United States Patent [19]

Chaiko

[11] 4,289,426

[45] Sep. 15, 1981

[54] FRICTION ROCK STABILIZER AND METHOD OF FORMING SAME, AND A METHOD OF STABILIZING AN EARTH STRUCTURE

[75] Inventor: Walter M. Chaiko, Titusville, N.J.

[73] Assignee: Ingersoll-Rand Company, Princeton, N.J.

[21] Appl. No.: 75,749

[22] Filed: Sep. 14, 1979

[51] Int. Cl.[3] ..... E21D 21/00; E21D 20/00

[52] U.S. Cl. ..... 405/259; 411/55; 411/60

[58] Field of Search ..... 405/259, 260, 261; 85/68, 8.3, 63

[56] References Cited

U.S. PATENT DOCUMENTS

| | | | |
|---|---|---|---|
| 922,980 | 5/1909 | Vernon et al. | 405/259 |
| 1,963,301 | 6/1934 | Gloystein | 85/68 X |
| 2,406,536 | 8/1946 | Gelpcke | 85/68 |
| 3,279,301 | 10/1966 | Fischer | 85/68 X |
| 3,693,359 | 9/1972 | Karara | 405/259 |
| 3,797,254 | 3/1974 | Askey et al. | 405/259 |
| 3,899,893 | 8/1975 | Banerjee et al. | 405/259 |
| 4,012,913 | 3/1977 | Scott | 405/259 X |
| 4,056,036 | 11/1977 | Kamann et al. | 405/259 X |
| 4,126,004 | 11/1978 | Lineboom | 405/259 |

*Primary Examiner*—Dennis L. Taylor

*Attorney, Agent, or Firm*—David W. Tibbott; Bernard J. Murphy

[57] ABSTRACT

The stabilizer invention comprises an improved, generally tubular friction rock stabilizer body for insertion into a borehole formed in a structure such as mine roof or side wall, or other subterranean opening for stabilizing the structure, the body having a maximum transverse dimension greater than borehole in which it is to be inserted, and requiring therefore considerable force to effect its borehole insertion, the stabilizer having a facility for attaching a pendant thereto. An end of the body has a threaded nut fixed therein which receives a threaded, elongate, suspension bolt as the pendant. Thus, the pendant bolt, having a terminal drive head, can engage and pendantly support an ancillary article, such as a roof plate, remotely from the stabilizer body. The stabilizing invention comprises stabilizing an earth structure through a given depth thereof with a shorter length friction stabilizer by substantially "bottoming" the stabilizer in a borehole in the earth structure of the given depth, attaching one end of an elongate extension piece to the "bottomed" stabilizer, and mounting an earth structure retention plate, on the opposite end of the extension piece, securely against the earth structure. Finally, the stabilizer-forming invention comprises fixing a pendant-receiving fastener to an end of a standard earth or rock friction stabilizer for pendantly attaching a roof plate, or the like, thereto.

7 Claims, 3 Drawing Figures

FRICTION ROCK STABILIZER AND METHOD OF FORMING SAME, AND A METHOD OF STABILIZING AN EARTH STRUCTURE

In the prior art, two basic approaches are used in supporting mine roofs with "roof bolts". One approach is to lock the mine roof structure bedding planes or lamina together and, thereby, resist lateral shifting of each lamina relative to the next. This is known as the "beam-building" approach, and it is the principal used with superior results by resin or cement-grouted roof bolts, and by friction rock stabilizers; the latter is exemplified by U.S. Pat. No. 3,922,867, issued Dec. 2, 1977, to James J. Scott, for "Friction Rock Stabilizers". However, there are many occasions where the roof immediately above the mining is incompetent, too unconsolidated or whatever, and is incapable of being supported as a beam and, typically, it will fall out to the height of the beam. Accordingly, six-foot roof bolts or stabilizers bring a six-foot roof fall, etc. In such a case, a second approach called "suspension" is often used. A hole of sufficient length (often twelve to fourteen feet) to reach competent rock is drilled and a point anchor is inserted (in the competent rock). The roof is then supported by a roof plate which is attached to the point anchor, by a steel rod, and fixed against the roof surface. Presently, mechanical expansion-type, point anchors are used for this purpose, and they suffer from the fact that very highly localized loads, and consequent stresses, are placed on the rock in the vicinity of the point anchor. This causes the rock to deteriorate thereat, with a subsequent and consequential loss of support from the point anchor and a resultant loss of support for the roof.

It is an object of this invention to disclose an improved friction rock stabilizer which serves the aforesaid "suspension" purpose without the disadvantages inherent in, and the failures experienced with the use of, prior art point anchors.

Particularly it is an object of this invention to set forth an improved friction rock stabilizer, for installation in a bore of predetermined cross-sectional dimension which is formed in a structure such as a roof or side wall of a mine shaft or other underground opening, for anchoring said stabilizer in such bore to stabilize such roof or side wall structure, said stabilizer comprising an elongate body having wall means having an outer surface for frictionally engaging the inner surface of the structure bore, said body further having a cross-sectional dimension which is greater than said predetermined dimension of such structure bore to require a substantial insertion force to effect installation of said body into said bore, and said wall further having a thickness, configuration, and material composition which are responsive to forces applied to and along said wall by the inner surface of such bore, upon said stabilizer having been forceably inserted thereinto, to cause a frictional engagement of said wall with the inner surface of such bore substantially along the full length thereof; wherein the improvement comprises means made integral with said body for receivably attaching thereto, and suspending therefrom, an elongate pendant for fixing an ancillary article, such as a roof plate, to said pendant to effect remote suspension of said article relative to said body.

It is another object of this invention to teach an improved friction rock stabilizer, for installation in a bore of predetermined cross-sectional dimension which is formed in a structure such as a roof or side wall of a mine shaft or other underground opening, for anchoring said stabilizer in such bore to stabilize such roof or side wall structure, said stabilizer comprising an elongate body having wall means having an outer surface for frictionally engaging the inner surface of the structure bore, said body further having a cross-sectional dimension which is greater than said predetermined dimension of such structure bore to require a substantial insertion force to effect installation of said body into said bore, and said wall further having a thickness, configuration, and material composition which are responsive to forces applied to and along said wall by the inner surface of such bore, upon said stabilizer having been forceably inserted thereinto, to cause a frictional engagement of said wall with the inner surface of such bore substantially along the full length thereof; wherein the improvement comprises in combination, means made integral with said body for replaceably attaching thereto, and pendantly suspending therefrom, an elongate pendant for fixing an ancillary article, such as a roof plate, to said pendant to effect remote suspension of said article relative to said body; and a pendant replaceably attached to said integral means and suspended therefrom.

Yet another object of this invention is to teach a method of stabilizing an earth structure through a given depth thereof with a friction stabilizer having a length of less than said depth, comprising the steps of forming a borehole of the given depth in said earth structure; installing a friction stabilizer having a length of less than said given depth, fully into said borehole until it substantially bottoms therein; attaching one end of an elongate extension article to the installed stabilizer; and mounting an earth structure retention plate on the opposite end of said article securely against the earth structure.

A further object of this invention is to disclose a novel method of forming a friction stabilizer for insertion in a bore in an earth structure, such as a roof or side wall of a mine shaft or other underground opening, for anchoring the structure, and pendantly supporting an earth structure retention plate, said stabilizer comprising a generally tubular body of substantially one cross-sectional configuration along substantially its full length, said body having a maximum transverse dimension predetermined to be larger than the maximum transverse dimension of the bore in which it is to be inserted, whereby insertion of said body in such bore causes circumferential compression of said body, the stabilizer being free of structure precluding such circumferential compression, and said body being of material which, in response to a bore insertion of said stabilizer (a) permits both said circumferential compression of said body, and a transverse deformation thereof as well, in the event of a shift of a section or sections of said bored structure in a plane transverse to the length of said stabilizer; and (b) causes said body, to frictionally engage the wall of the bore, thereby to anchor the bored structure, substantially fully along a continuous and substantially full length of said body, with a given, substantially uniformly distributed, anchoring force; the method comprising the step of fixing a fastener to an end of said body for attaching a pendant to said fastener.

Figure 2:
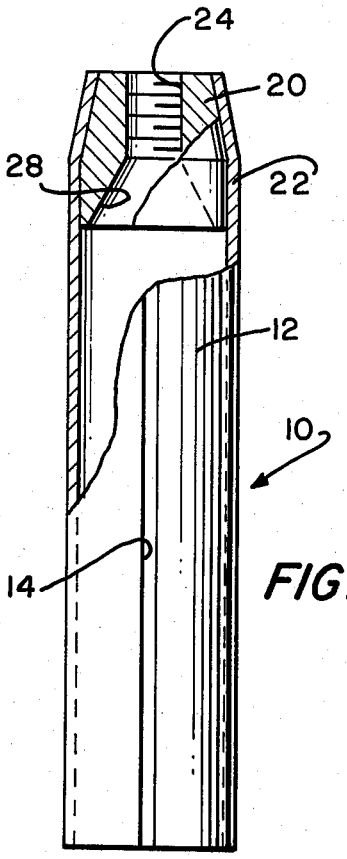
FIG. 2 is an enlarged, partial view, of the embodiment of FIG. 1, partly cross-sectional, showing the uppermost end of the stabilizer.

As shown in the Figures, the improved stabilizer 10 comprises a tubular body 12 with a slot 14 through its length, much like the Stabilizer of U.S. Pat. No. 3,922,867, but provision is made for engaging a rod 16 for suspending a roof plate 18. The rod engagement employed in this embodiment is a round nut 20 welded to the upper or tapered end 22 of the stabilizer 10. The nut 20 has a threaded hole 24 to engage the threaded end 26 of the rod 16 and has a conical section 28 to guide the rod into the threads. The length, as well as the metallurgy and gage, of the stabilizer material may be varied to provide the desired anchorage characteristics in the earth structure 30.

To use the improved stabilizer 10, in accordance with the novel earth-stabilizing method of my invention, a hole 32 is drilled in the structure 30 to the necessary installation height. The hole 32 comprises an over-sized section 34 to the height of the lower end 36 of the stabilizer, and a section 38 of proper diameter for the frictional engagement thereof by the stabilizer 10. The diameter of section 38, of course, may be varied to adjust anchorage characteristics. The stabilizer is inserted into section 38 and pushed or impacted into proper, full installation by a push rod-type device 40 driven by an impactor or a thrusting machine (not shown). The device 40 has an annular trough 42 in which to engage the lower end 36 of the stabilizer. When the stabilizer 10 is fully inserted, the device 40 is removed and a threaded rod 16 with a roof plate 18 attached is inserted into the hole 34 and into the body 12. The conical section 28 of the nut 20 guides the rod 16 into the threads. The rod 16 is torqued up, using the bolt head, in the traditional manner to apply loading to the roof plate 18 and, consequently, the structure 30.

The major benefit of this teaching, as compared to the mechanical point anchor practice, is that it avoids a concentrated load and stress concentration on the rock. Therefore, the anchorage does not deteriorate with time (as with the point anchor). On the contrary, friction rock stabilizer devices increase anchorage with time, due to locking in with bedding plane shifts, bonding, through corrosion on the tube exterior, and closure around the hole in ground with high horizontal stress. As a result, roof plate loads and structure roof support are maintained rather than bleeding down (as with point anchors). As compared to resin-grouted anchors, the improved friction stabilizer 10 is less expensive and easier to use. If very large movements are encountered in the structure 30 during an initial load adjustment, due to the mining activity, the stabilizer 10 will merely slip and re-anchor itself without loss of support. A point anchor or grouted bolt would fail under such conditions.

Figure 1:
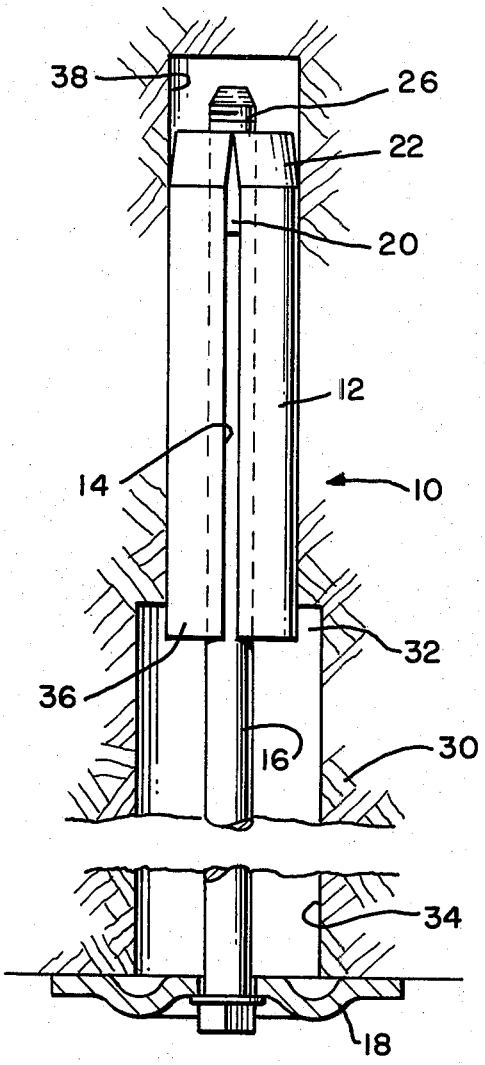
FIG. 1 is an elevational view of an embodiment of the invention installed in an earth structure bore.
Figure 3:
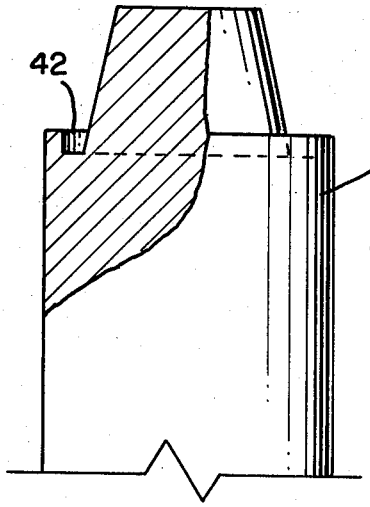
FIG. 3 is an elevational, partial view of a stabilizer push rod device, the latter shown partly cross-sectioned.

While I have described my invention in connection with a specific embodiment of stabilizer, and methods of earth-stabilization, it is to be clearly understood that this is done only by way of example, and not as a limitation to the scope of my invention as set forth in the objects thereof and in the appended claims. My invention also, of course, comprises a method of forming an earth structure friction stabilizer, comprising fixing a pendant-attaching fastener to an end of the stabilizer. It is a stabilizer so formed which is shown in FIGS. 1 and 2, the stabilizer 10 having a round nut 20 fixed to the "upper" end 22 thereof. While this is a preferred method of forming the stabilizer, it is not the only method comprised by my invention. For instance, the nut 20 could be fixed within, or adjacent to, lower end 36 (rather than at the top). In this, end 36 could be tapered—to engage the nut thereat, by welding (however, a different type of insertion push rod would have to be employed), or a nut having a diameter corresponding to the inside diameter of end 36 can be welded therewithin—slightly recessed, to accommodate the push-rod device 40. These, and further alternative embodiments of the stabilizer, and methods of forming such, will occur to those skilled in this art. However, such proceed from my teaching, and are deemed to be within the ambit thereof and embraced by my claims.

As set forth herein, the improved stabilizer 10 is described for use in an extended hole 32, to reach competent rock with a stabilizer having a length of less than such reach. Alternatively, in subterranean openings having a low head room, short-length stabilizers 10 can be employed, and can be set in considerable-depth holes, as the "suspension" rod 16 may be bent (to accommodate the low head room), and then straightened, to facilitate its reach into the stabilizer 10, and finally engaged with the nut 20.

I claim:

1. A method of stabilizing an earth structure through a given depth thereof with a friction stabilizer having a length of less than said given depth, comprising the steps of:

forming a borehole of a given circumferential dimension and of the given depth in said earth structure;

stabilizing the earth structure along a first length of said given depth and substantially fully about the circumference of said first length by installing a friction stabilizer having a generally tubular body, which is conformable to said given circumferential dimension, and having a length substantially corresponding to said first length, fully into said borehole until it occupies substantially the entirety of said first length and frictionally engages substantially the full circumference of said first length with a given, substantially uniformly-distributed anchoring force; and stabilizing the earth structure along the remaining length of said given depth by attaching one end of an elongate extension article to the installed stabilizer; and mounting an earth structure retention plate on the opposite end of said article securely against the earth structure, to lend support and stabilization to the remaining length of said depth.

2. A method, according to claim 1, wherein said attaching step comprises fixing an article-attaching element to an end of the stabilizer, before performing said installing step, and attaching said one end of said extension article to said element following said installing step.

3. A method, according to claim 2, wherein said fixing step comprises securing fastener to said end of the stabilizer.

4. A method, according to claim 2, wherein said fixing step comprises securing a threaded fastener to said end of the stabilizer, and said attaching step comprises threadedly attaching an elongate rod, having threads formed on said one end, to said fastener.

5. A method, according to claim 2, wherein said fixing step comprises fixing said element to the end of the stabilizer which is to substantially bottom in the borehole.

6. A method, according to claim 1, wherein said attaching step comprises attaching an extension element having a length which is substantially equal to the given depth of said borehole.

7. An improved friction stabilizer, for installation in one bore of a plurality of axially aligned bores of diverse, predetermined cross-sectional dimensions which are formed in a structure such as a roof or side wall of a mine shaft or other underground opening, for anchoring said stabilizer in such one bore to stabilize such roof or side wall structure therealong, said stabilizer comprising an elongate body having wall means having an outer surface for frictionally engaging the inner surface of the one structure bore, said body further having a bore-entry leading end and a trailing end and a greatest cross-sectional dimension throughout a principal length thereof, from said trailing end toward said leading end, which is greater than the predetermined dimension of such one bore to require a substantial insertion force to effect installation of said body into said one bore, and said wall further having a thickness, configuration, and material composition which are responsive to forces applied to and along said wall by the inner surface of such one bore, upon said stabilizer having been forceably inserted thereinto, to cause a frictional engagement of said wall with the inner surface of such one bore substantially along the full length thereof; wherein the improvement comprises:

a hard metal threaded fastener made integral with said body for receivably attaching thereto, and suspending therefrom, an elongate pendant for fixing an ancillary article, such as a roof plate, to said pendant to effect remote suspension of said article relative to said body, and to support and stabilize the bored structure.

* * * * *

UNITED STATES PATENT AND TRADEMARK OFFICE

CERTIFICATE OF CORRECTION

PATENT NO. : 4,289,426

DATED : September 15, 1981

INVENTOR(S) : Walter M. Chaiko

It is certified that error appears in the above—identified patent and that said Letters Patent is hereby corrected as shown below:

Column 4, line 61 (claim 3, line 2), before "fastener", insert --a--; and

Column 6, line 1 (claim 7, line 13), before "from", insert --at least--, and following "from", insert --adjacent to--.

Signed and Sealed this

*Third* Day of *November 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,289,426

DATED : September 15, 1981

INVENTOR(S) : Walter M. Chaiko

It is certified that error appears in the above—identified patent and that said Letters Patent is hereby corrected as shown below:

Column 6, line 5 (claim 7, line 17), following

"wall" insert--means--;

Column 6, line 7 (claim 7, line 19), following

"wall" insert--means--; and

Column 6, line 10 (claim 7, 22), following

"wall" insert--means--.

Signed and Sealed this

*Third* Day of *August 1982*

[SEAL]

*Attest:*

GERALD J. MOSSINGHOFF

*Attesting Officer*

*Commissioner of Patents and Trademarks*